United States Patent [19]

Le et al.

[11] Patent Number: 4,501,652

[45] Date of Patent: Feb. 26, 1985

[54] PROCESS FOR SELECTIVE REMOVAL OF CCR, ARSENIC AND CONJUGATED DIOLEFINS FROM SHALE OIL

[75] Inventors: Quang N. Le, Westville; Daniel J. Neuman, Cherry Hill, both of N.J.

[73] Assignee: Mobil Oil Corporation, New York, N.Y.

[21] Appl. No.: 544,021

[22] Filed: Oct. 20, 1983

[51] Int. Cl.[3] ..... C10G 65/06; C10G 67/06

[52] U.S. Cl. ..... 208/57; 208/89; 208/251 R; 208/251 H

[58] Field of Search ..... 208/251 H, 210, 211, 208/57, 89, 251 R

[56] References Cited

U.S. PATENT DOCUMENTS

| | | | |
|---|---|---|---|
| 3,795,607 | 3/1974 | Adams et al. | 208/210 |
| 3,933,624 | 1/1976 | Myers | 208/253 |
| 3,985,643 | 10/1976 | Milstein | 208/210 |
| 4,003,829 | 1/1977 | Burger et al. | 208/253 |
| 4,344,840 | 8/1982 | Kunesh | 208/59 |
| 4,354,927 | 10/1982 | Shih et al. | 208/251 H |

*Primary Examiner*—Delbert E. Gantz
*Assistant Examiner*—O. Chaudhuri
*Attorney, Agent, or Firm*—Alexander J. McKillop; Michael G. Gilman; Charles J. Speciale

[57] ABSTRACT

A hydrocarbonaceous feedstock upgrading process is disclosed. Spent nickel arsenide-containing catalyst from demetallation guard chambers or hydroprocessing operations are utilized to upgrade the hydrocarbonaceous feedstock prior to dearsenation. The spent catalysts have significant activity for diolefin saturation and CCR removal at temperatures low enough to reduce olefin polymerization reactions.

7 Claims, No Drawings

PROCESS FOR SELECTIVE REMOVAL OF CCR, ARSENIC AND CONJUGATED DIOLEFINS FROM SHALE OIL

BACKGROUND OF THE INVENTION

1. Field of the Invention

This invention relates to a process for upgrading hydrocarbonaceous fluids and, particularly, to a process for upgrading retorted shale oil prior to dearsenation by contacting the oil at moderate temperatures over a catalytic guardbed in the presence of hydrogen. The catalytic guardbed comprises deactivated guard chamber or hydrotreating catalyst from a downstream operation.

2. Description of Prior Art

Due to the scarcity of other hydrocarbon fuels and energy resources in general, shale oil and other hydrocarbonaceous fluids such as those derived from coal, bituminous sands, etc., are expected to play an increasing role in the production of commercial hydrocarbon fuels in the near future. Substantial effort is being devoted to the development of cost-efficient refining techniques for the processing of these hydrocarbonaceous fluids. For the purposes of this invention, hydrocarbonaceous fluids include crude oil, heavy oil, vacuum residue, solvent-deasphalted oil, solvent-deasphalted residue, crack oil, shale oil, tar sand oil and natural asphalt. These hydrocarbons contain various non-metallic and metallic impurities which may adversely affect further hydrocarbon treatment processes. Of the trace metals in the hydrocarbonaceous fluids, arsenic and iron are the most predominant, e.g., greater than 20 ppm. Failure to remove these metals during the upgrading process often results in processing problems. For example, some arsenic compounds are water soluble and thus can cause pipeline corrosion. Additionally, when hydrocarbons are upgraded by delayed coking, many of the metals are rejected in the coke, resulting in lower quality coke. Further, the upgraded catalysts are irreversibly poisoned by the metals deposition. Further, many hydrocarbons have potential $As_2O_3$ emission problems when burned directly as a fuel. As a result, it is preferable to remove these metals from the hydrocarbonaceous fluids prior to any downstream processing, or direct use.

Removing these metals generally requires reaction temperatures of 500° F. or greater. These reaction temperatures result in polymerization or coking reactions by the conjugated diolefins present in the hydrocarbonaceous fluids, which cause fouling problems in the reaction. Therefore, both trace metals and conjugated diolefins must be removed from the hydrocarbonaceous fluids in order to reduce excessive polymerization or coking during the downstream operations.

Saturation of the olefins can take place in the presence of hydrogen. It is commonly known in the petroleum industry to use palladium or platinum as pyrolysis gasoline saturation catalysts for this process. These catalysts, while retaining diolefin saturation activity, have virtually no aromatic saturation activity.

Nickel arsenide has been shown in prior art to be an effective catalyst for selective hydrogenation of diolefins to monoolefins. Johnson (U.S. Pat. Nos. 3,697,448; 3,787,511; U.S. Pat. No. 3,900,526 and U.S. Pat. No. 4,020,119) is directed to the use of nickel arsenide aluminum catalysts for the selective hydrogenation of diolefins. These compounds can also hydrogenate organic sulfur compounds, carbonyls and acetylenes. Additionally, antimony can be used in place of arsenic and nickel can be substituted with iron and/or cobalt. The reaction is carried out at temperatures of 75°-750° F., a pressure of 1000 psig and a LHSV (liquid hourly space velocity) of 0.1 to 10.

The use of nickel-containing catalysts for dearsenation is also known. Wunderlich (U.S. Pat. No. 4,069,140) is directed to the use of NiS and $MoS_3$ on $Al_2O_3$ as well as high pore volume supported nickel. Young (U.S. Pat. No. 4,046,674) is directed to the use of a NiMo/refractory oxide catalyst.

The use of $NiMo/Al_2O_3$ for hydrodenitrogenation of shale oil is well known in the literature. See for example J. R. Katzer and R. Sivasubramarian, *Catal. Rev. Sci. Eng.* 20(2), 155-208, (1979). The catalysts described therein are irreversibly poisoned by arsenic and consequently must be discarded because 100% dearsenaton of shale oil in the guard chamber is probably not feasible.

While all of these processes may be effective, they generally employ relatively expensive catalysts which are permanently deactivated and thus discarded. Additionally, many of the reactions described in the foregoing processes require reaction temperatures which would induce olefinic polymerization and thus reactor fouling.

OBJECTS OF THE INVENTION

It is an object of this invention to provide an improved process for upgrading hydrocarbonaceous fluids.

It is another object of this invention to provide an improved process for upgrading a hydrocarbonaceous fluid prior to dearsenation by contacting the fluid at moderate temperatures over a catalyst in the presence of hydrogen.

It is still another object of this invention to provide an improved process for upgrading retorted shale oil utilizing a low temperature catalytic upgrading step upstream of the dearsenation process.

It is a further object of this invention to provide an improved process for upgrading a hydrocarbonaceous fluid by employing a deactivated guard chamber or hydrotreating catalyst recovered from a downstream operation.

It is another object of this invention to provide an improved process for upgrading hydrocarbonaceous fluids using a catalyst which can saturate diolefins and remove Conradson Carbon Residue (CCR) at temperatures low enough to reduce olefin polymerization reactions.

It is a further object of this invention to provide an improved process for upgrading hydrocarbonaceous fluids which decreases the feed coking tendencies of the guard chamber and hydrotreating processes thus enabling higher start of cycle temperatures, higher space velocity for equivalent production quality and/or longer cycles.

It is still another object of this invention to provide an improved process for upgrading hydrocarbonaceous fluids, which method is inexpensive and does not substantially contribute to the processing cost of the fluid.

These and other objects will become apparent from the specification which follows.

SUMMARY OF THE INVENTION

It has now been found that a hydrocarbonaceous feedstock may be upgraded by contacting the fluid with a hydrocarbon upgrading catalyst in the presence of hydrogen and at a temperature between 300° and 800° F., passing the fluid over a bed of fresh demetallation guard chamber catalyst, and further passing the fluid over a bed of fresh hydroprocessing catalyst, wherein the hydrocarbon upgrading catalyst for the first step comprises the deactivated catalyst of either of the demetallation guard chamber or the hydroprocessing steps. It has been found that this process substantially saturates the diolefin content of a hydrocarbonaceous fluid and removes most of the metallic and nonmetallic impurities.

DETAILED DESCRIPTION OF THE INVENTION

The present invention may be practiced in an existing hydrocarbon upgrading unit in which a hydrocarbon such as shale oil may be upgraded to a syncrude. For the purposes of describing the invention, retorted shale oil will be used. It should be apparent to one skilled in the art that any of the abovementioned hydrocarbonaceous fluids may be substituted herein.

Prior to dearsenation of the retorted shale oil, the shale oil is upgraded in a first catalytic reaction step. The upgrading process saturates the diolefinic content of the shale oil, and removes much of the CCR. Thus, by using a low temperature catalytic upgrading step upstream of the guard chamber reaction step, the unsaturated or conjugated diolefins in the retorted shale oil will become saturated. The inventive concept lies in the catalyst for the upgrading step. During the downstream guard chamber and/or hydroprocessing steps, arsenic and iron from the shale are deposited on the catalysts forming stable nickel arsenides and iron arsenides. These arsenides have significant low temperature diolefin saturation activity. Catalysts which have been deactivated from either the demetallation guard chamber step or the hydroprocessing step, i.e., steps from the downstream operation are used in the first catalytic upgrading step. The deactivated catalysts contain nickel arsenides which catalyse the saturation of the conjugated diolefins. The catalyst to be used will be dependent upon the type of process to be performed. In many cases, the catalyst will be a supported catalyst and the demetallation or hydroprocessing properties will be provided by metals or metal compounds present on the support.

Refractory materials, such as a alumina, silica and silica-alumina, are very suitable as supports. Very suitable metals with demetallation or hydroprocessing activity are metals of Groups VI and VIII of the Periodic Table of Elements, such as molybdenum, tungsten, cobalt and nickel. Preference is given to catalysts containing at least one metal from Group VI and at least one metal from Group VIII, e.g., a catalyst containing nickel together with molybdenum or tungsten. Preferred examples of fresh guard chamber catalysts are $Ni/Al_2O_3$, $NiMo/Al_2O_3$, and $NiW/Al_2O_3$. Examples of preferred fresh hydroprocessing catalyst are $NiMo/Al_2O_3$ and $NiW/Al_2O_3$. The metals may be present as such or in the form of compounds, such as oxides, sulfides or other salts. If desired, other elements, such as halogens, e.g. fluorine or chlorine, may be present in the catalyst.

It will be clear from the description given that the components of the catalyst are not limited; in any specific case the composition of the catalyst will be dependent on the guard chamber or hydroprocessing reaction to be carried out.

The temperature in the upgrading reactor may vary between wide limits. However, in order to induce optimum diolefin saturation activity, the upgrading step should be reacted at low temperatures, i.e., between 300° and 800° F., and preferably between 500° and 700° F.

The pressure to be applied may vary between wide limits and may even be as high as 2000 pounds/square inch. However, one the specific advantages of the present invention is to be found in the applicability of relatively low hydrogen pressures. Hydrogen pressures as low as about 400 pounds/square inch may be used, but it is preferred to use about 1000 pounds/square inch.

Pure hydrogen may be used, but this is not necessary. A gas with a hydrogen content of 50% or more by volume is very suitable. A hydrogen-containing gas originating from a catalytic reforming plan may be used with advantage.

The weight hourly spaced velocity may vary between wide limits, and may be different in each of the three reactors. Weight hourly spaced velocities will suitably be in the range of about 0.1 to about 10 and preferably about 2.

Although ebullated catalyst beds, in which the oil passes in upflow through the reactors, may be used, it is preferred to use a fixed bed of catalyst or a moving fixed bed of catalyst and pass the oil in downflow through the reactor.

The transportation of the catalyst from the demetallation guard chamber reactor or the hydroprocessing reactor to the upgrading step reactor may be carried out in any desired manner; pumping of a slurry of the catalyst in a oil is very suitable. If desired, the catalyst may be freed from entrained oil by washing with a suitable oil, which may be the feed of the reactor in which the catalyst is to be introduced.

Therefore, the present invention provides an improved process for upgrading a hydrocarbonaceous feedstock by saturating unsaturated diolefins prior to dearsenation by using a deactivated catalyst from one of the downstream reactor steps. The activation of the catalyst for diolefin saturation occurs during the normal deactivation of the catalyst for dearsenation or hydroprocessing. This catalyst provides an economically more desirable upgrading process than a synthesized diolefin catalyst, such as $Pd/A_2O_3$, and, unlike $Pd/A_2O_3$, the catalyst resists metal poisoning. Further, the diolefin saturation and CCR removal at the upgrading step are accomplished at temperatures low enough to reduce the olefin polymerization reactions in any downstream reactor steps. Additionally, the deactivated catalyst from the demetallation guard chamber and/or hydroprocessing treatment steps, provide an improvement over fresh non-arsenide catalyst because non-arsenide catalysts require higher temperatures to achieve diolefin saturation, temperatures which would normally be sufficiently high enough to promote the polymerization reactions thus resulting in furnace tube fouling and shortened cycles.

Although the invention has been described in conjunction with specific embodiments thereof, it is evident that many alternatives and variations will be apparent to those skilled in the art in light of the foregoing description. Accordingly, it is intended to embrace all such alternatives and variations that fall within the spirit and scope of the appended claims.

What is claimed is:

1. A process for upgrading hydrocarbonaceous fluids said fluids containing arsenic, conjugated diolefins and Conradson Carbon Residue, comprising in sequence:

(a) contacting said fluids with a hydrocarbon upgrading catalyst and hydrogen at a temperature between 300° and 800° F.;

(b) passing the resulting fluids of step (a) through a demetallation guard chamber, said guard chamber comprising a bed of fresh demetallaton guard chamber catalyst, said fresh demetallation guard chamber catalyst being selected from the group comprising $Ni/Al_2O_3$, $NiMo/Al_2O_3$, and $NiW/Al_2O_3$; and (c) passing the resulting fluids of step (b) through a hydroprocessing chamber under conditions which deposit said arsenic on a bed of fresh hydroprocessing catalyst, said fresh hydroprocessing catalyst being selected from the group comprising $NiMo/Al_2O_3$ and $NiW/Al_2O_3$, wherein said hydrocarbon upgrading catalyst is the deactivated catalyst of either of said demetallation guard chamber or said hydroprocessing chamber.

2. The process according to claim 1 wherein said hydrocarbon upgrading catalyst comprises nickel arsenide.

3. The process according to claim 1 wherein said hydrocarbon upgrading catalyst comprises iron arsenide.

4. The process according to claim 1 wherein said temperature is between 500° and 700° F.

5. The process according to claim 1 wherein said hydrocarbonaceous feedstock is shale oil.

6. The process according to claim 5 wherein said shale oil is retorted shale oil.

7. A process for upgrading hydrocarbonaceous fluids prior to dearsenation said fluids containing arsenic, conjugated diolefins and Conradson Carbon Residue, comprising in sequence:

(a) contacting said fluids with a hydrocarbon upgrading catalyst and hydrogen at a temperature between 300° and 800° F.;

(b) passing the resulting fluids of step (a) through a demetallation guard chamber, said guard chamber comprising a bed of fresh demetallation guard chamber catalyst, said fresh demetallation guard chamber catalyst being selected from the group comprising $Ni/Al_2O_3$, $NiMo/Al_2O_3$, and $NiW/Al_2O_3$; and (c) passing the resulting fluids of step b) through a hydroprocessing chamber under conditions which deposit said arsenic on a bed of fresh hydroprocessing catalyst, said fresh hydroprocessing catalyst being selected from the group comprising $NiMo/Al_2O_3$ and $NiW/Al_2O_3$, wherein said hydrocarbon upgrading catalyst is the deactivated catalyst of either of said demetallation guard chamber or said hydroprocessing chamber.

* * * * *